United States Patent [19]

Brower et al.

[11] 4,188,029

[45] Feb. 12, 1980

[54] MULTIPLE USE WEIGHT LIFTING EXERCISING DEVICE

[76] Inventors: Harold E. Brower; Jeffrey H. Brower, both of 30815 28th Ave. South, Federal Way, Wash. 98003

[21] Appl. No.: 850,595

[22] Filed: Nov. 11, 1977

[51] Int. Cl.[2] ..... A63B 21/06

[52] U.S. Cl. ..... 272/62; 272/145; 248/636; 272/DIG. 4; 272/118

[58] Field of Search ..... 272/118, 117, 134, 143, 272/144, DIG. 4, 145, 62; 248/636

[56] References Cited

U.S. PATENT DOCUMENTS

| | | | |
|---|---|---|---|
| 3,103,357 | 9/1963 | Berne | 272/134 X R |
| 3,614,097 | 10/1971 | Blickman | 272/62 X |
| 3,647,209 | 3/1972 | LaLanne | 272/118 |
| 3,815,903 | 6/1974 | Blomquist | 272/118 |
| 3,850,431 | 11/1974 | Winans | 272/118 |

FOREIGN PATENT DOCUMENTS

| | | | |
|---|---|---|---|
| 524962 | 5/1956 | Canada | 272/118 |

*Primary Examiner*—Richard C. Pinkham
*Assistant Examiner*—William R. Browne
*Attorney, Agent, or Firm*—Seed, Berry, Vernon & Baynham

[57] ABSTRACT

A multi-purpose weight lifting type exercising device is disclosed for lifting weights with a cable supported by an upright frame. An exercise beam is pivotally connected for vertical movement to a cross member of the frame, the cross member secured to the frame intermediate the upper and lower end. On the free end of the exercise beam is an adjustable exercise bar which can be employed in a first position for standing military press bar and in a second position as a bench press bar. The exercise beam is secured to a vertically displaceable weight member positioned beneath and secured to the exercise beam. A cable secured at one end to the weight member through the exercise beam extends through a cable guide member secured to the frame. The outer end of the cable is secured either to an exercise bar employed for rowing exercises, shoulder shrugs, etc. or to an extension cable which leads to a leg exercising machine secured to a bench. The exercising device also includes an integral chin bar as a part of the frame and an exercise board which can be inclined in various positions against the frame of the exercising device.

8 Claims, 4 Drawing Figures

MULTIPLE USE WEIGHT LIFTING EXERCISING DEVICE

BACKGROUND OF THE INVENTION

1. Field of the Invention

This invention relates to a multi-purpose body exercising device in which weights are used.

2. Description of the Prior Art

Weight lifting type exercise devices for body conditioning are well known. For example, U.S. Pat. Nos. 3,438,627; 3,635,472; 3,746,338; and 3,647,209 disclose devices for lifting weights with cables that are supported by and guided over upright frames. While certain of the exercising devices disclose that they are multi-purpose in nature, there are many exercises which cannot be performed without separate, independent equipment.

SUMMARY OF THE INVENTION

It is a primary object of this invention to provide a compact, multi-purpose body exercising device for development of a variety of the muscles of the entire human body.

It is another object of this invention to provide a body exercising device which occupies a minimum of floor space.

It is a further object of this invention to provide a body exercising device wherein the amount of weight attached to the device can be easily adjusted.

It is a still further object of this invention to provide a body exercising device wherein the direction of pulling force by the user of the device can be modified for exercising various muscles.

The exercise device includes a support frame with vertical supports connected by cross members. An exercise beam is pivotally connected at one end to a cross member of the frame for vertical movement. An exercise bar capable of being gripped and urged by muscular effort in a vertical direction is secured to the other end of the exercise beam. Weight means are positioned beneath and secured to the exercise beam, the weight means mounted for slidable vertical displacement along guide means secured to the frame. Cable guide means are mounted on the frame above the exercise beam. A cable secured at one end to the weight means through the exercise beam extends through the cable guide means and connects either to an exercise bar or to a leg exercising device. The exercising device may also include a integral chin bar and an exercise board which can be inclined against the frame of the device relative to the floor on which the device sits.

DETAILED DESCRIPTION OF THE PREFERRED EMBODIMENTS

Figure 1:
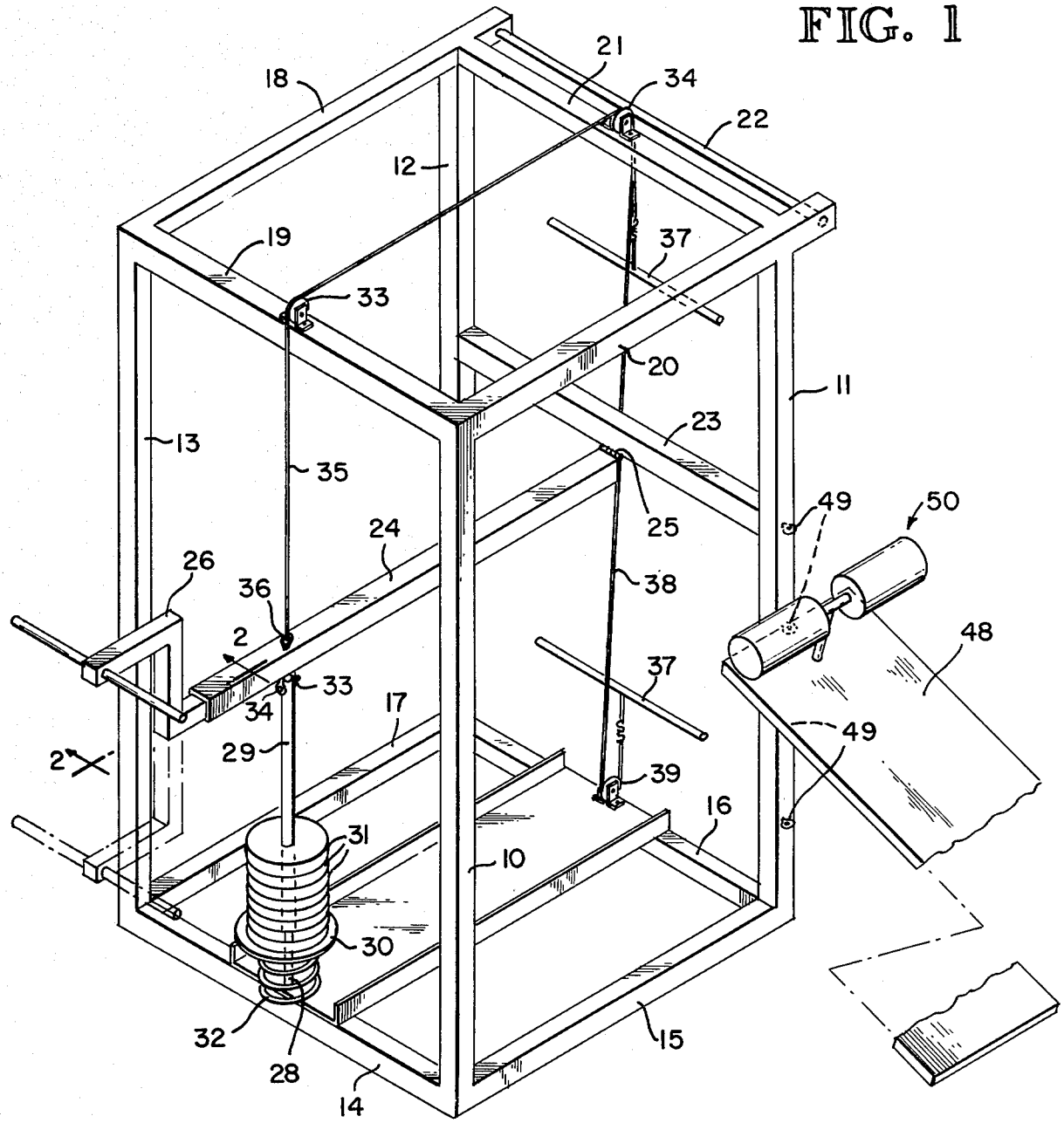
FIG. 1 is a perspective view of the body exercising device claimed herein.
Figure 2:
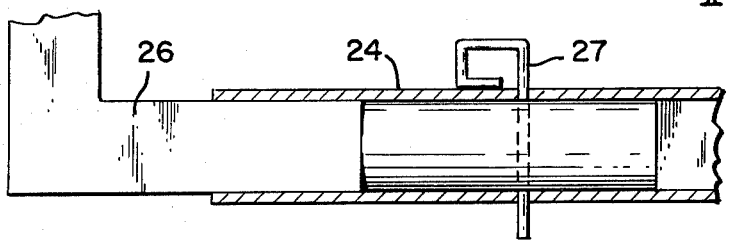
FIG. 2 is a partial cross section along section line 2—2 of FIG. 1 of the exercise beam.

Referring to the drawings, FIG. 1 illustrates the weight lifting device which is generally composed of a frame assembly constructed of stainless steel or similar suitable high strength material. The frame structure illustrated is in the form of a rectangular cage; however, the frame can be of any suitable configuration. The frame assembly illustrated in FIG. 1 includes four vertical posts 10, 11, 12 and 13 connected together by respective lower horizontal members 14, 15, 16 and 17 and upper horizontal members 18, 19, 20 and 21. Two of the upper members 18 and 20 extend beyond the plane formed by vertical posts 11 and 12 as illustrated in FIG. 1. A chin bar 22 is secured between the horizontal members 18 and 20. The frame may be secured to any horizontal floor surface by a suitable means. A horizontal cross beam 23 is secured between vertical supports 11 and 12 at a level from the floor ranging from four to six feet. An exercise beam 24, extending transversely of the horizontal cross beam 23, is pivotally connected thereto by a suitable hinge 25. The beam 24 extends beyond the plane formed by vertical supports 10 and 13. An exercise bar 26 is adjustably secured to the exercise beam 24. In the positions shown in solid lines in FIG. 1 the exercise bar is in the up position and is useful for standing exercises such as a standing military press. The bar may be turned 180° to the lower position shown in dotted lines in FIG. 1 for exercises such as the bench press. The configuration of the exercise bar may be as desired. A key 27 extending through the exercise beam 24 and bar 26, as shown in FIG. 2, may be used to retain the bar in a preset position.

Figure 4:
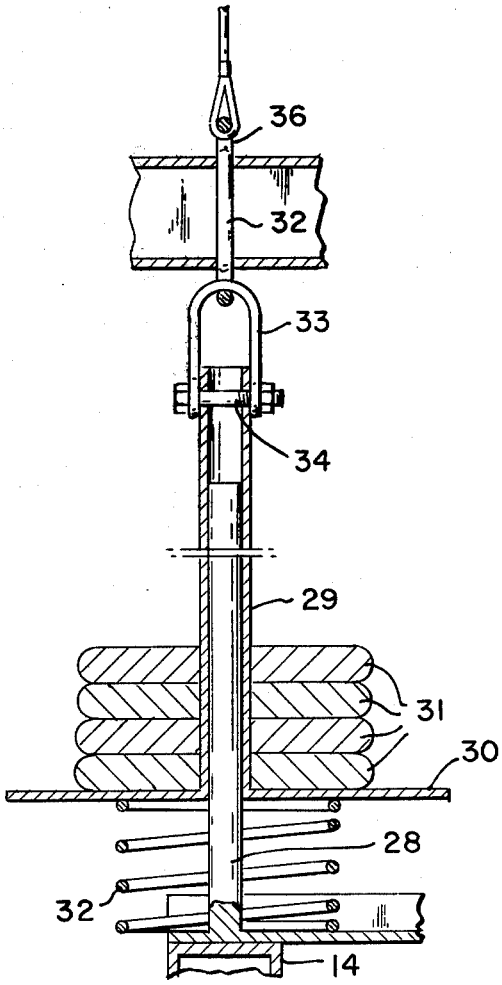
FIG. 4 is a partial cross section of a plurality of weights and the method of securing the weights to the exercise beam and cable means.

Weight means mounted for slidable, vertical displacement are positioned beneath and secured to the exercise beam 24. The weights, which may be conventional barbell weights (as illustrated in FIG. 1) are guided vertically by a vertical rod 28 secured at its lower end to the horizontal member 14 of the frame directly beneath the exercise beam. A hollow elongated sleeve 29 having a flat plate 30 secured to the lower end thereof on which one or more weights 31 can rest, is slidably mounted for vertical displacement over the vertical rod 28 as illustrated in FIG. 4. Means may be employed for selectively attaching an array of weights in any desired quantity to the lower end of cable 35 or exercise beam 24. A compression spring 32 may be disposed between the plate 30 and the frame member 14 to absorb the impact of the weights falling from an elevated position during use of the exercise device. Connection means for detachably securing the sleeve and weights to the exercise beam 24 at the upper end of the sleeve 29 may be employed. As illustrated in FIG. 4 the means may include a U-shaped bracket 33 whose legs are secured to the sleeve 29 by bolt 34. The U-shaped bracket is then detachably secured to an eyelet 36 fixedly mounted to the exercise beam 24.

The exercise bar and beam connected to the weight means can be used for a number of exercises such as the standing military press, the bench press, the shoulder shrug, etc. For other exercises the weight means are attached by a cable and pulley arrangement to exercise bars located as illustrated in FIG. 1. Referring to FIG. 1 guide pulleys 33 and 34 are secured respectively to horizontal frame members 19 and 21 substantially in the same plane as the exercise beam 24. The cable 35 secured at one end to an eyelet 36 on the upper surface of the exercise bar 24, extends over pulleys 33 and 34 with the free end of the cable 35 connected to an exercise bar 37 as illustrated in FIG. 1. In this position the exercise bar can be used for a number of exercises. It will be noted that the direction from which force must be applied to lift the weights 31 using the exercise bar 37 is modified from that employed in use of the exercise bar and beam 24 and 26. Through application of sufficient tension, whatever weights are secured to the vertically displacable weight means, are caused to be vertically displaced and thereby produce conditioning of whichever muscles of the human body are being employed to produce the tension.

Alternatively, the exercise bar 37 may be detached from the cable 35 so that an additional length of cable 38 can be secured thereto. This additional length of cable is guided downward through another guide pulley 39 secured to horizontal frame member 16 as illustrated in FIG. 1. The exercise bar 37 may then be secured to the free end of cable 38 and be used for exercises such as a rowing exercise with the feet braced against the horizontal frame member 16, for curling exercises or for other suitable exercises. Again, it should be noted that the direction from which the force must be applied to lift the weights of the weight means is modified by this further arrangement.

Figure 3:
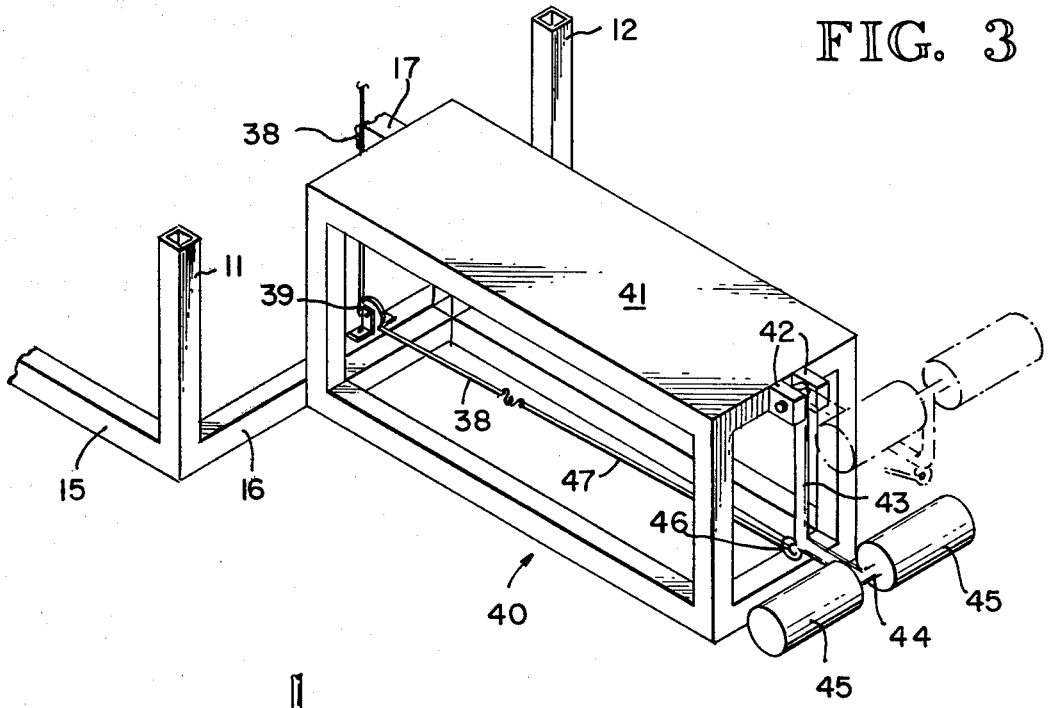
FIG. 3 is a perspective view of a bench attachment useful with the body exercising machine as a leg machine.

Still another alternative which is illustrated in FIG. 3 is to use a bench having leg exercise means secured to one end thereof with the leg exercise means secured by a detachable cable to the cable 38 as illustrated. Referring to FIG. 3 the bench includes an appropriate frame structure 40 having a horizontal planar surface 41 thereon which may be padded if desired. On one end of the bench is a pair of laterally extending flanges 42 to which one end of an exercise bar 43 is pivotally attached. On the other end of the L-shaped bar is a handle 44 which may include pads 45 for comfort. The exercise bar 43 is secured to a cable 47 by suitable means such as an eyelet arrangement 46. The other end of the cable is detachably secured by suitable means to cable 38. The L-shaped bar is pivotable as illustrated in FIG. 3. The exercise bar 43 is useful for exercising the legs by bracing the legs behind the padded bars 45 and attempting to raise or pivot the bar 43 about its pivotal connection to flanges 42 against the weights placed on the weight means.

The exercising device also includes means for connecting an exercise board 48 to the frame of the exercising device. Such means may include a hook and eyelet arrangement as illustrated in FIG. 1 with eyelets 49 placed at spaced intervals along the length of a vertical support member such as support member 11 and a detachable hook member secured to the underside of the inclined board for securement to one of the eyelets 49. The exercise board suitably includes a foot rest 50 against which a person braces his feet in a head down position while exercising doing sit-ups or other exercising. The board 48 may be provided with padding if desired. As illustrated, the lower end of the exercise board rests on the floor with the upper end may be inclined upwardly at a desired angle depending on the wish of the person using it.

The amount of weight may be added or subtracted to the exercising device by detachably removing the sleeve 29 from the exercise bar 24 and adding or substracting the number of weights from the weight lifting means.

The overall unit is compact and provides means for exercising a wide variety of muscles without the need of additional apparatus. Conventional weights used for barbell weights may be used and the amount of weight changed with ease.

We claim:

1. A multi-purpose weight lifting type exercising device comprising:

a support frame including vertical upright supports connected by cross-members, an exercise beam pivotally connected at one end to one cross-member of the frame for vertical movement about the pivot point and including on the other end a first exercise bar capable of being gripped and urged by muscular effort in a vertical direction, weight means secured to the exercise beam mounted for slidable vertical displacement along guide means secured to the support frame, the weight means including a vertical guide rod secured to the frame beneath the exercise bar, a hollow elongated sleeve member having means thereon for supporting a plurality of vertically stacked weights slidably mounted for vertical displacement over the vertical guide rod, the sleeve member detachably secured at one end to the exercise beam, first cable guide means fixedly mounted to the support frame above the exercise beam, second cable guide means laterally spaced from the first cable guide means and fixedly mounted to the frame above the exercise beam, third cable guide means laterally spaced from the first cable guide means and fixedly mounted to the support frame below the second cable guide means and the exercise beam, a first cable segment secured at one end to the exercise beam and weight means and extending through the first and second cable guide means, and a second exercise bar secured to the free end of the cable segment capable of being gripped and urged by muscular effort against the weight of the weight means so that application of a pulling force on the exercise bar and first cable segment displaces the weight means as well as the exercise beam and first exercise bar vertically.

2. The device of claim 1 including a second cable segment connected to the first cable segment and extending through the third cable guide means, the second exercise bar detachably secured to the free end of the second cable segment for applying a pulling force on the cable by muscular effort to displace the weight means as well as the exercise beam and first exercise bar vertically.

3. The device of claim 2 including a bench provided with a horizontal support surface a third exercise bar pivotally mounted to the bench at one end capable of being pivoted vertically by muscular effort of the legs, means for securing the third exercise bar to a third cable segment connected to the weight means and exercise beam through the first and second cable segments so that application of a pulling force on the third cable segment through the third exercise bar by muscular effort displaces the weight means and exercise beam vertically.

4. The device of claim 1 including a planar elongated exercise board, means at spaced intervals along one of the vertical supports for securing one end of the planar elongated exercise board, the board including retaining means at the end secured to the vertical support for bracing of the feet of the person using the board.

5. The exercising machine of claim 1 wherein the first exercise bar is adjustably secured to the exercise beam for movement between an "upper" position for standing exercises and a "lower" position for bench press exercises.

6. A multi-purpose body exercising machine comprising:

a cage-like frame including two pairs of spaced vertical frame members joined by two pair of horizontal support members at the upper and lower ends thereof, a cross member extending between two of the vertical supports intermediate the upper and lower ends of the vertical supports, an exercise beam pivotally connected at one end to the cross member for vertical movement about the pivot point, the exercise beam including an adjustable exercise bar on the opposite end capable of being gripped and urged by muscular effort in a vertical direction, a vertical guide rod secured to one of the lower horizontal support members beneath and laterally spaced from the horizontal cross member to which the exercise beam is secured, a hollow elongated sleeve member having means thereon for supporting a plurality of vertically stacked weights, the sleeve member and weights mounted for slidable, vertical displacement over the vertical guide rod, the sleeve member detachably secured at one end to the exercise beam, first cable guide means fixedly mounted to an upper horizontal support member of the frame above the exercise beam and weights, second cable guide means laterally spaced from the first cable guide means in the same plane thereof fixedly mounted to an upper horizontal support member of the frame, third cable guide means fixedly mounted to a lower horizontal support member of the frame beneath the second cable guide means and the pivot point of the exercise beam, a cable segment secured at one end to the weights through the exercise beam and extending through the first, second and third cable guide means, and a second exercise bar detachably securable to the free end of the cable segment for applying a pulling force on the cable segment by muscular effort to displace the weights and exercise beam vertically.

7. The exercising machine of claim 6, wherein two of the upper horizontal support members have portion that extend beyond the plane formed by the vertical supports of the frame, the extended portions are connected by a horizontal rod serving as a chin bar.

8. The exercising machine of claim 6, including a third exercise bar, a bench with a horizontal support surface having pivotally mounted on one end thereof the third exerise bar, the third exercise bar detachably securable to the end of the cable segment to which the second exercise bar is attachable for applying a pulling force on the cable segment through the third exercise bar by muscular effort of the legs to displace the weight means and exercise beam vertically.

* * * * *